United States Patent [19]

Hill

[11] 4,281,472

[45] Aug. 4, 1981

[54] FINGER TOY

[76] Inventor: Dennis R. Hill, 5620 Washington Ave., Des Moines, Iowa 50310

[21] Appl. No.: 178,843

[22] Filed: Aug. 18, 1980

[51] Int. Cl.[3] ..... A63H 33/40

[52] U.S. Cl. ..... 46/53; 46/154; 46/76 R

[58] Field of Search ..... 46/53, 58, 154, 1 H, 46/76 R, 1 R, 179, 1 F; 294/25; 63/15

[56] References Cited

U.S. PATENT DOCUMENTS

| | | | |
|---|---|---|---|
| 1,432,628 | 10/1922 | Slocum | 46/154 |
| 2,092,942 | 9/1937 | Trollen | 46/179 |
| 2,497,527 | 2/1950 | Bacon | 46/53 |
| 3,691,669 | 9/1972 | Folson et al. | 46/1 H |
| 3,911,618 | 10/1975 | Gerst | 46/154 |
| 4,031,656 | 6/1977 | Kupperman et al. | 46/53 |

*Primary Examiner*—Gene Mancene
*Assistant Examiner*—Mickey Yu
*Attorney, Agent, or Firm*—Zarley, McKee, Thomte, Voorhees & Sease

[57] ABSTRACT

A finger toy, which may be integrally formed and molded of plastic material, for mounting on a single digit and comprising a body portion having a front nose end with an attached pinwheel or propeller, and a rear end opening which provides access to an interior body cavity, sized for receiving a digit. The shape of the interior body cavity is designed so that it will be finger-gripping for secure but releaseable attachment of the toy to a user's finger.

4 Claims, 6 Drawing Figures

FINGER TOY

BACKGROUND OF THE INVENTION

This invention relates to a novelty toy, primarily designed for use by children. The toy is designed to be safe, economical of manufacture, and suitable for entertaining use by children, as well as others.

Accordingly, a primary object of this invention is to provide a safe, useful toy for children.

Another object of this invention is to provide a safe, useful and economical toy for use by children which may be integrally formed and molded, for example, in an injection molding machine.

A further object of this invention is to provide a safe, economical novelty toy designed for attachment over the uttermost extremity of a person's finger.

Another object of the invention is to provide a safe, economical novelty toy which will securely, but releaseably, grip the outer extremity portion of a person's digit.

An even further object of the invention is to provide a novelty toy which has an associated stand for resting of the device when it is not in use.

A still further object of this invention is to provide an injection moldable plastic toy, designed for attachment to a person's finger, with the internal cavity of the toy of such a construction that it securely but releaseably will grip the finger, and further with the body portion of the plastic material shaped like the configuration of an airplane, and having outwardly extending wings, a tail section, a front nose attaching propeller, and the shape of a pilot character sitting in the cockpit. The result is an action toy with a rotatable propeller which spins when the wearer's hand is thrust through an air space.

SUMMARY OF THE INVENTION

Figure 1:
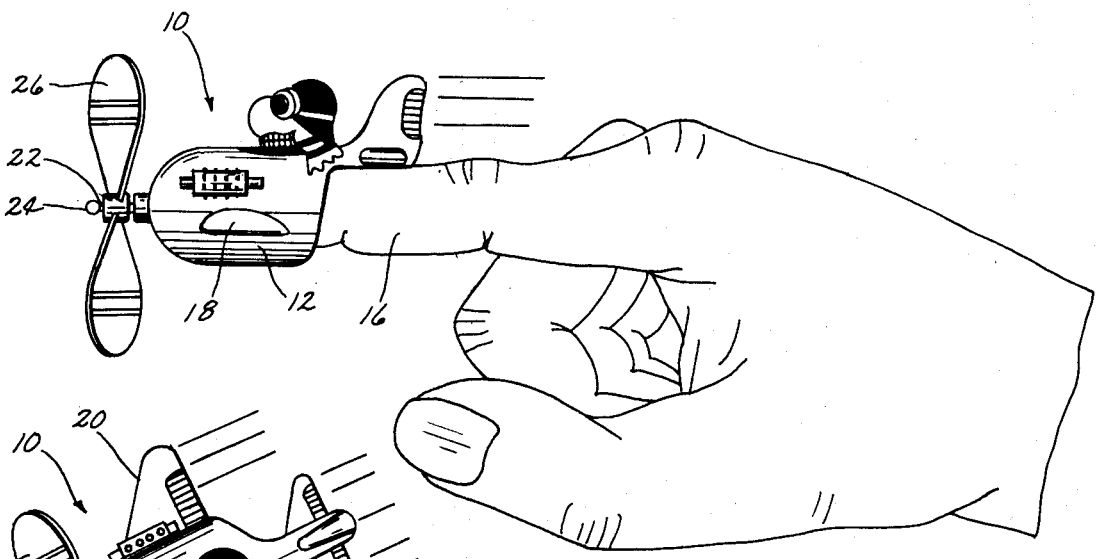
FIG. 1 is a perspective view of the toy placed on a user's hand.
Figure 2:
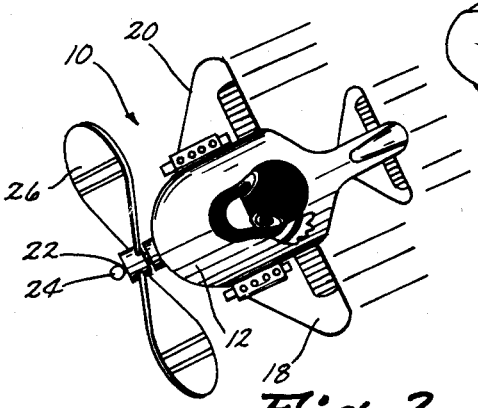
FIG. 2 is a plan view of the toy.
Figure 3:
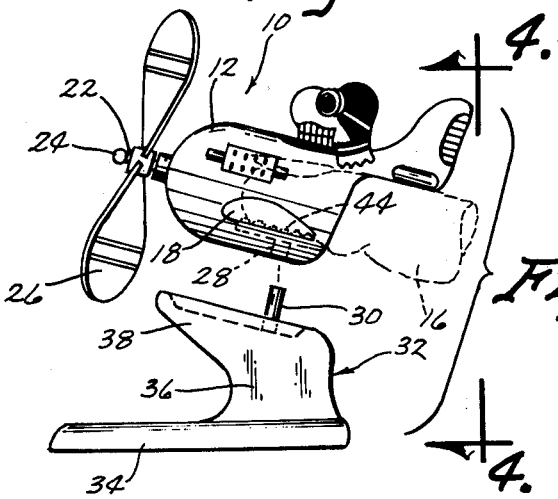
FIG. 3 is an elevated side view showing the toy and its associated stand.

A novelty toy designed primarily for attachment to a user's index finger. The toy simulates the shape and flying motion of an airplane, since the body portion of the toy is in the shape of an airplane, with the forward nose having a rotatable propeller. The interior cavity portion of the toy has a gripping means for gripping the wearer's finger to assure that it will not come off during use of the action toy. Also provided is a stand for stationary rest for the toy when not in use.

DETAILED DESCRIPTION OF THE INVENTION

The toy 10 is comprised of a body 12 which is generally circular in transverse cross-section. The body 12 and the walls thereof (not specifically numbered, define an annular interior cavity 14, the details of which will be hereinafter provided. However, cavity 14 is of a sufficient size to allow mating receipt of, for example, an index finger 16.

Extending transversely to the longitudinal axis of body 12 along its sides are wings 18 and 20 and at the rear, tail section 21.

Protruding from the center portion of the nose end of body 12 is a propeller shaft 22 which terminates at its front end portion in a bead 24. Shaft 22 and bead 24 may be separate and distinct parts or may be molded directly as a part of the overall body portion 12. Propeller 26 fits over bead 24 onto shaft 22 for rotatable movement about the axis of shaft 22. At the center of propeller 26 is an aperture (not depicted). This aperture is of sufficient size such that if the propeller 26 is, for example, of a plastic material, it may be squeezed over bead 24 and is freely rotatable about the longitudinal axis of shaft 22. Bead 24 then acts to prevent propeller 26 from falling off of the front end of shaft 22.

Located at the bottom of body portion 12 generally in a central position is bore 28. Bore 28 is of a sufficient diameter so that prong 30 may be inserted into bore 28 to allow the unit to sit upon resting stand 32, shown with particular reference to FIGS. 4 and 5. There, it can be seen that stand 32 is comprised of a base portion 34, and extending upwardly therefrom pedestal 36 which terminates into rest bench 38, with prong 30 extending upwardly from rest bench 38 to allow the body 12 of toy 10, via bore 28, to rest thereupon.

Turning now to a description of the detail of the internal cavity 14. The cavity 14 is designed to allow it to have finger gripping capability. There are two specific embodiments shown. One is shown in FIGS. 4 and 5 and the other in FIG. 6.

Figure 4:
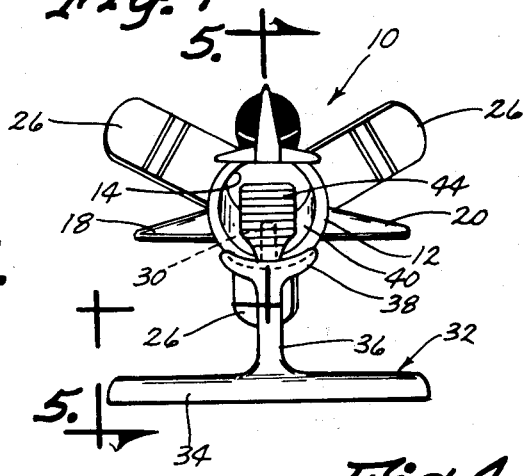
FIG. 4 is a rear end view of the toy as it sits on its associated stand.
Figure 5:
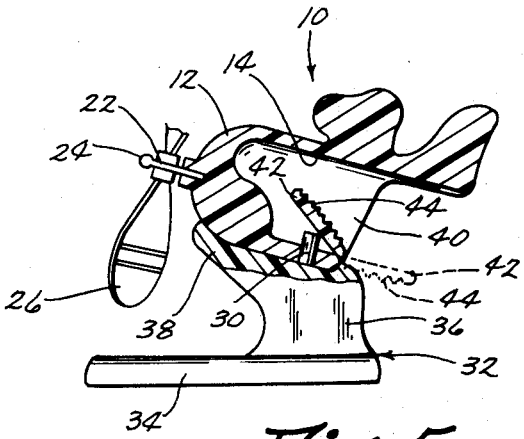
FIG. 5 is a sectional view along line 5—5 of FIG. 4 showing in longitudinal cross-section the toy and one of the finger gripping means embodiments of the invention.

Turning first to FIGS. 4 and 5, it can be seen that the internal cavity 14 has adjacent its lower surface and extending rearwardly from opening 40, bendable rear tab 42. Tab 42 is shown in its fully opened position in dotted line relationship in FIG. 5. However, since the body 12 is made of a flexible plastic material, tab 42 may be bent upwardly and inwardly through opening 40 to the position depicted in FIG. 5. The serrated edges 44 in the inclined position shown in FIG. 5, grip the finger 16 along its underside and are biased against the finger to provide a releaseable, but secure, gripping. Suitable plastic materials from which the body portion may be made to provide its necessary flexibility, include polyethylene and polypropylene amongst other polymeric plastic materials having sufficient flexibility to allow a bendable and yieldable hinge relationship as defined and hereinbefore described.

Figure 6:
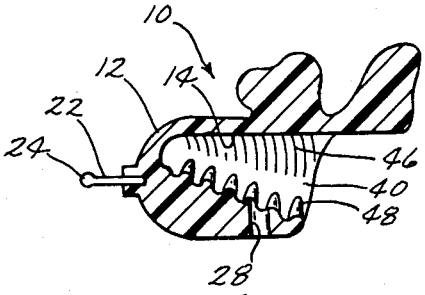
FIG. 6 is a sectional view similar to the section along line 5—5 of FIG. 4, but showing a second finger gripping embodiment for the interior cavity portion of the toy.

Another alternative embodiment to provide the finger gripping capability is shown in FIG. 6. There, it can be seen that internal cavity 14 has adjacent its upper edges a plurality of mildly protruding threads 46. Adjacent the bottom of cavity 14 are longer protruding threads 48. Longer protruding threads 48, when one's finger is thrust into cavity 14, grip the fleshy portion of the finger. Thus, they have a tendency to provide a secure but releaseable grip upon the user's finger. It can therefore be seen that the invention accomplishes at least all of its stated objectives.

What is claimed is:

1. A finger toy for mounting on a single digit, comprising:

a body portion in the shape of an airplane having a front nose end and a rear end opening, said rear end opening providing access to an interior body cavity, sized for receiving a digit, and finger gripping means operatively associated with said interior body cavity for secure but releaseable gripping of a digit when it is thrust into said body cavity, and a propeller rotatably mounted on said front nose end for responsive rotary motion when air is rushed past the same.

2. The device of claim 1 wherein said cavity is characterized by a plurality of shorter downwardly extending threads from its top portion and a plurality of longer upwardly extending threads from its lower portion.

3. The device of claim 1 wherein said body portion includes a lower, rearwardly extending flexible and hingedly attached tab having serrated edges on its one side, which is bendable forwardly and inwardly within the cavity portion to allow gripping of an index finger by a user.

4. The device of claim 1 wherein said body portion has internally extending central bore for receipt of a prong of a toy stand for resting as a toy on said stand.

* * * * *